US007494238B2

(12) United States Patent
Kuo

(10) Patent No.: US 7,494,238 B2
(45) Date of Patent: Feb. 24, 2009

(54) LUMINOUS SKIRT

(75) Inventor: San-Lien Kuo, Dongguan (CN)

(73) Assignee: Sun Solutions Ltd., Dongguan (CN)

( * ) Notice: Subject to any disclaimer, the term of this patent is extended or adjusted under 35 U.S.C. 154(b) by 99 days.

(21) Appl. No.: 11/657,616

(22) Filed: Jan. 25, 2007

(65) Prior Publication Data

US 2008/0101059 A1 May 1, 2008

(30) Foreign Application Priority Data

Oct. 25, 2006 (CN) ..... 2006 1 0150749

(51) Int. Cl.
*F21V 33/00* (2006.01)

(52) U.S. Cl. ..... 362/103; 362/184; 362/234; 362/249; 362/360

(58) Field of Classification Search ..... 362/184, 362/234, 249, 356, 357, 360, 103, 108
See application file for complete search history.

(56) References Cited

U.S. PATENT DOCUMENTS 5,019,438 A * 5/1991 Rapisarda ..... 428/102
5,366,780 A * 11/1994 Rapisarda ..... 428/102

* cited by examiner

*Primary Examiner*—Thomas M Sember
(74) *Attorney, Agent, or Firm*—Bacon & Thomas PLLC

(57) ABSTRACT

A luminous skirt includes a transparent outer skirt cover and a luminous inner skirt cover. The inner skirt cover consists of an inner skirt, and outer skirt fitted with the inner skirt for receiving conducting wires therebetween, a cell bag for fixing a cell box, a luminous body shade for scattering light fully, a cell box connected by conducting wires, a switch and a plurality of luminous bodies. The cell box is firmly fastened with the luminous skirt in which the conducting wires are firmly and safely connected. The luminous bodies are fixed in position by the luminous body shade and have excellent effects on light scattering and light emission. The outer skirt cover of the luminous skirt can be conveniently removed alone for facilitating cleaning.

6 Claims, 5 Drawing Sheets

LUMINOUS SKIRT

BACKGROUND OF THE INVENTION

1. Field of the Invention

This invention relates to a luminous skirt, particularly to one able to firmly fix luminous bodies in position and having an excellent effect on light scattering and light emission.

2. Description of the Prior Art

A luminous skirt is a skirt provided with luminous bodies able to automatically give out gorgeous light in the course of performance so as to make a festival conspicuous and ameliorate the atmosphere and effect of stage performance.

Generally, a conventional luminous skirt has the following defects.

1. The conducting wires of luminous bodies are usually provided on the surface of the skirt, and a cell box in unstably connected with the skirt, rendering the conducting wires likely to be pulled broken or get entangled, or resulting in poor conduction.

2. The luminous bodies are not firmly fixed in position so they are easy to shift or fall off.

3. It has poor effect on both light scattering and light emission.

SUMMARY OF THE INVENTION

The objective of this invention is to offer a luminous skirt provided with concealed conducting wires in the interior, able to firmly fix luminous bodies in position, having an excellent effect of light emission, and facilitating cleaning.

The luminous skirt in the present invention includes a transparent outer skirt cover and an inner skirt cover. The inner skirt cover consists of an inner skirt, an outer skirt, a cell bag, a cell box, a plurality of luminous bodies, a transparent luminous body shade, a switch and conducting wires. The cell box is provided with a convex conductive wire opening having its end formed with a lug bored with an insert slot, and the conducting wires are guided out through the conductive wire opening. The cell bag contains an inner bag and an outer bag fitted with each other. The outer bag has the upper edge of its inner layer aligned to the waist portion of the outer skirt and fixedly sewed together, having its upper portion bored with a power line hole passing through both the inner layer of the outer bag and the outer skirt, and the inner bag has its end firmly bound with the insert slot of the cell box. The inner skirt has its upper edge folded and sewed together to form a waist portion, and the switch is secured inside the waist portion of the inner skirt. The inner skirt further has its lower portion disposed with a luminous area bored with a lower switch line hole, and the inner layer of its waist portion bored with an upper switch line hole, with a cloth tube connecting the upper and the lower switch line hole. The inner skirt and the outer skirt are overlapped and fitted with each other, and the outer skirt has its waist portion sewed together with a portion of the inner skirt at the upper side of the lower switch line hole, and the outer and the lower skirt have their lower edges aligned to each other and sewed together. The luminous bodies are positioned in the interior of the luminous body shade, which has its circumferential edge bored with plural thread holes spaced apart to be sewed with the luminous area between the inner skirt and the outer skirt. The switch has its peripheral edge bored with thread holes spaced apart to be sewed with the inner layer of the waist portion of the inner skirt. The conducting wires have the upper ends inserted through the power line hole and connected with the cell box and have the lower ends inserted through the upper switch line hole, the cloth tube and the lower switch line hole and then connected with the switch and the luminous bodies that are connected in parallel.

For the convenience of connecting the cell box and the connecting wires, the cell box is bored with a power plug slot at the front side of the conductive wire opening and, after the luminous bodies and the switch and the power plug are connected by the conducting wires, the power plug is inserted through a pocket hole form the surface of the outer skirt and connected with the power plug slot.

Further, the cell box is installed thereon with the switch for the convenience of controlling power source, and the transparent luminous body shade has its inner and outer surface respectively provided with light-scattering streaks crossing one another in order to intensify lighting.

Furthermore, the luminous bodies are made of three LEDs, which are connected in parallel and whose luminous colors respectively are red, green and blue.

Compared with the conventional luminous skirt, the luminous skirt of this invention has the following advantages.

1. The luminous skirt of this invention is composed of an outer skirt cover and an inner skirt cover fitted with each other; therefore, the outer skirt cover provided with no power source can be conveniently removed for cleaning.

2. The cell box is firmly bound with the end of the cell bag, and the luminous bodies are fixedly sewed together with the inner skirt cover, able to prevent the conducting wires from getting entangled or pulled broken.

3. The luminous bodies are LED, able to prolong service life and avoid getting burning hot, and the luminous body shade has its inner and outer surface respectively disposed with light-scattering streaks for scattering light fully, enabling the luminous skirt to emit light with excellent effect.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
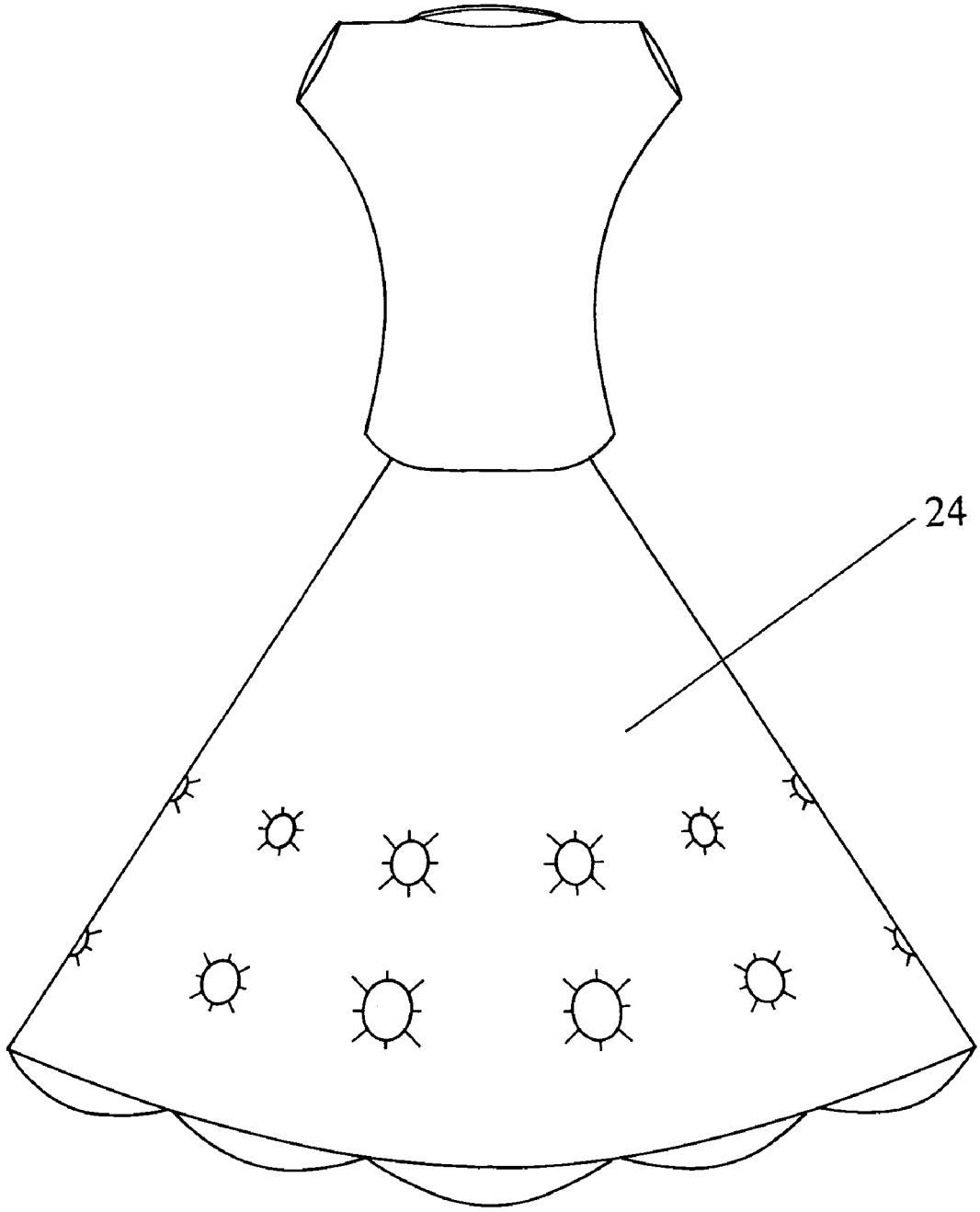
FIG. 1 is a front view of a luminous skirt in the present invention.
Figure 2:
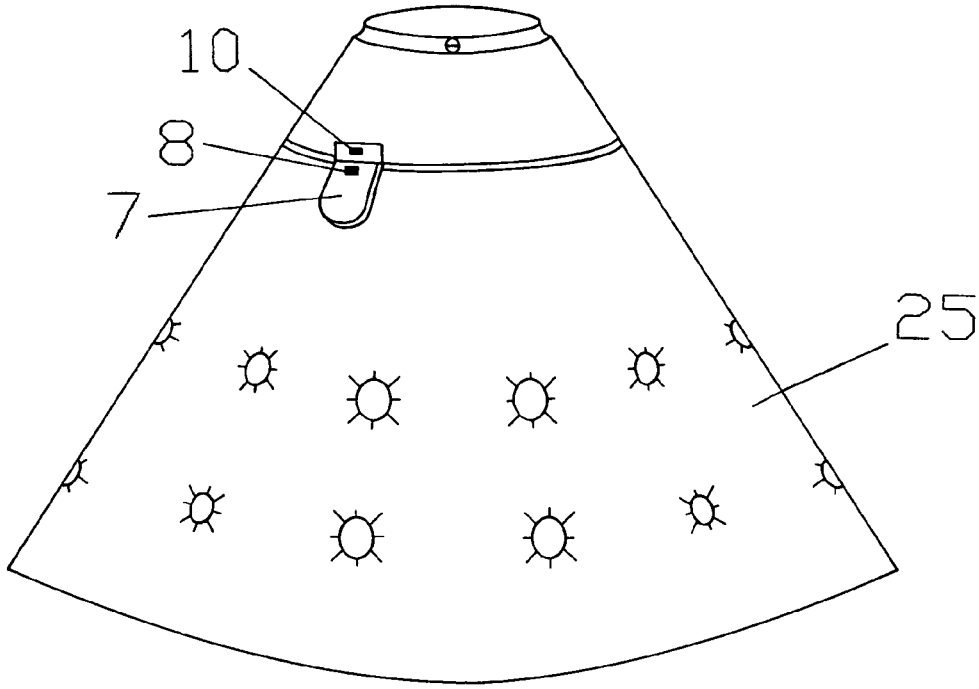
FIG. 2 is a front view of the inner skirt cover of the luminous skirt in the present invention.

A preferred embodiment of a luminous skirt in the present invention, as shown in FIGS. 1 to 7, includes a transparent outer skirt cover 24 and a luminous inner skirt cover 25 that consists of an outer skirt 1, an inner skirt 2, conducting wires 3, a cell box 4, a switch 11, a plurality of luminous bodies 20 and a transparent luminous body shade 18.

Figure 3:
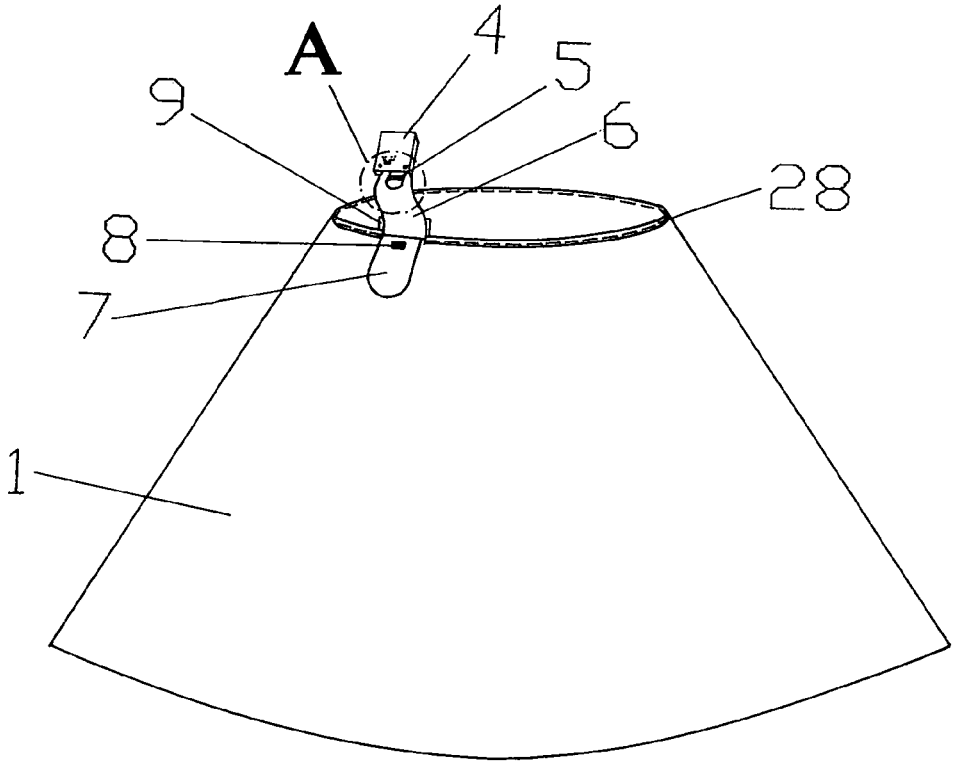
FIG. 3 is a front view of the outer skirt of the luminous skirt, which is fixed thereon with a cell box, in the present invention.

The outer skirt 1, as shown in FIG. 3, has its outer side provided with a cell bag having a pocket cover 9, an inner bag 6 and an outer bag 7. The cell bag and the pocket cover 9 are respectively provided with a Velcro band 8, 10. The inner bag 6 has its end bound together with a tying cord 16 for the insert slot of the cell box 4. The outer bag 7 has the upper edge of its inner layer aligned to the waist portion 12 of the outer skirt 1 and sewed together, and has its upper portion bored with a power line hole passing through the inner layer of the outer bag 7 and the pocket of the outer skirt 1.

The cell box 4, as shown in FIGS. 4-7, is disposed with a convex conductive wire opening 22 having its end provided with a lug cut with an insert hole 5, and the conducting wires 3 are guided out through the conductive wire opening 22.

The inner skirt 2 has its upper edge folded and sewed together to form the waist portion 12 having the switch 11 fixedly sewed therein. The inner skirt 2 further has its lower portion provided with a luminous area bored with a lower switch line hole 27, and the inner layer of the waist portion 12 of the inner skirt 2 bored with an upper switch line hole 21, with a cloth tube 14 positioned between the upper and the lower switch line hole 21, 27 and communicating with them. The outer skirt 1 and the inner skirt 2 are overlapped and fitted with each other. The outer skirt 1 has its waist portion 28 sewed together with a portion of the inner skirt 2 near the upper side of the lower switch line hole 27, and the outer skirt 1 and the inner skirt 2 have their lower edges aligned to each other and fixed together.

The luminous bodies 20 are positioned in the interior of the transparent luminous body shade 18, having its circumferential edge bored with a plurality of thread holes 26 spaced apart for threads 13 to be inserted therethrough to firmly fix the luminous body shade 18 with the luminous area between the outer skirt 1 and the inner skirt 2.

The switch 11 positioned inside the waist portion 12 of the inner skirt 2 has its peripheral edge bored with plural thread holes to be sewed with the inner layer of the waist portion 12 of the inner skirt 2.

The conducting wires 3 has the upper ends inserted through a power line hole 23 and connected with the cell box 4, having the lower ends inserted through the upper switch line hole 21 and the cloth tube 14 as well as the lower switch line hole 27 and then connected with the switch 11 and the luminous bodies 20, which are connected in parallel.

Figure 4:
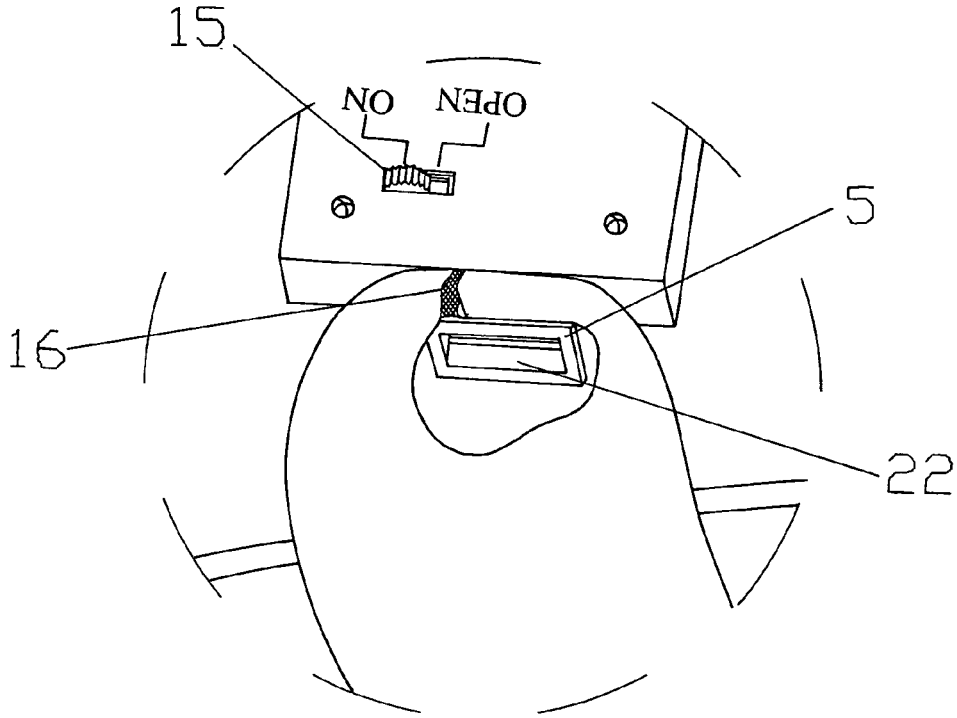
FIG. 4 is a magnified view of the mark A in FIG. 3.
Figure 5:
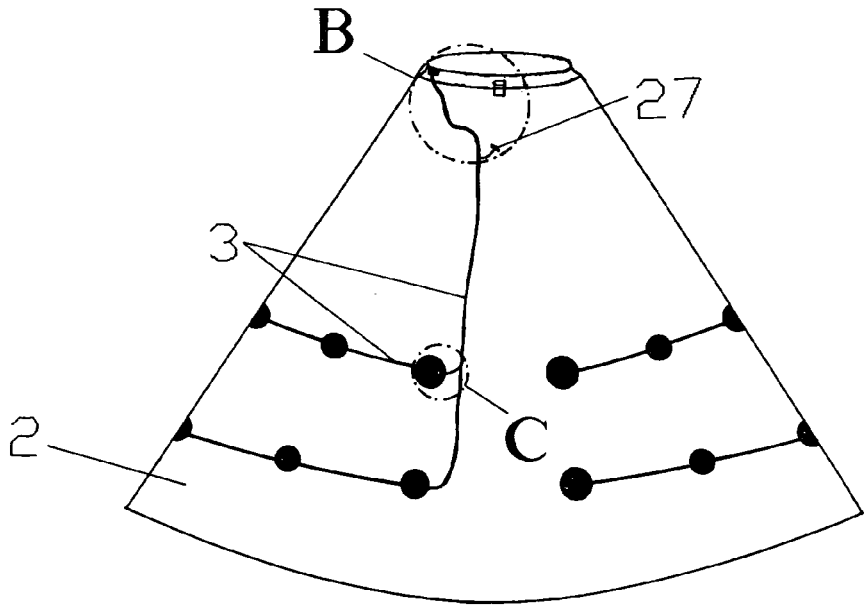
FIG. 5 is a front view of the inner skirt of the luminous skirt, which has its luminous bodies connected together, in the present invention.
Figure 6:
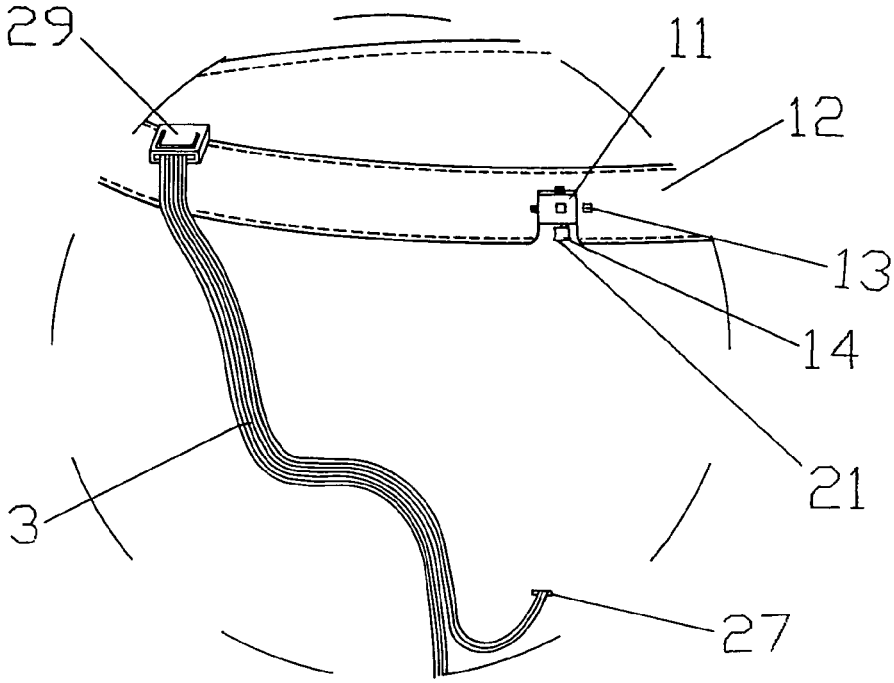
FIG. 6 is a magnified view of the mark B in FIG. 5 in the present invention.
Figure 7:
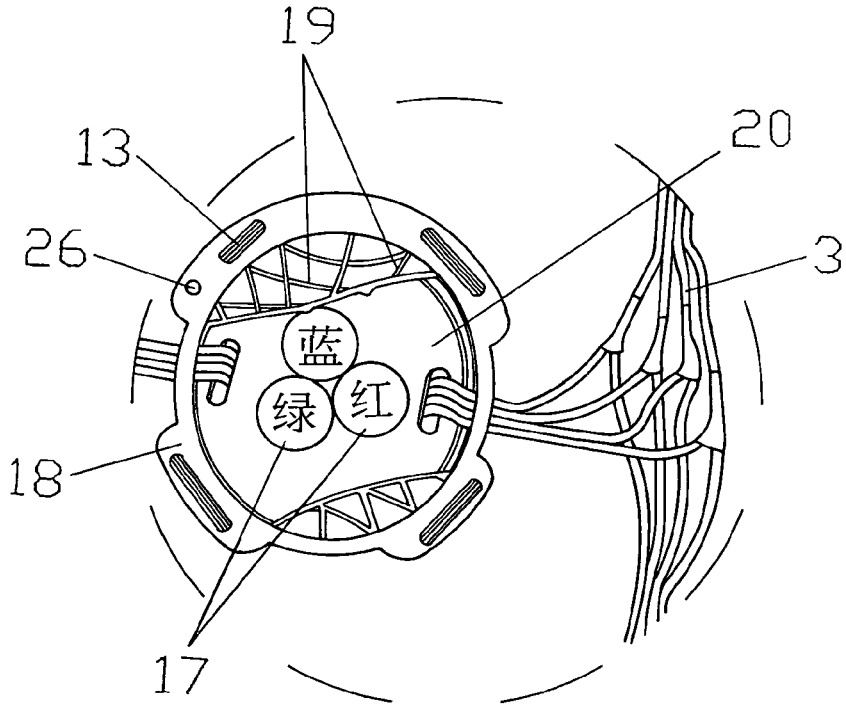
FIG. 7 is a magnified view of the mark C in FIG. 5 in the present invention.
Figure 8:
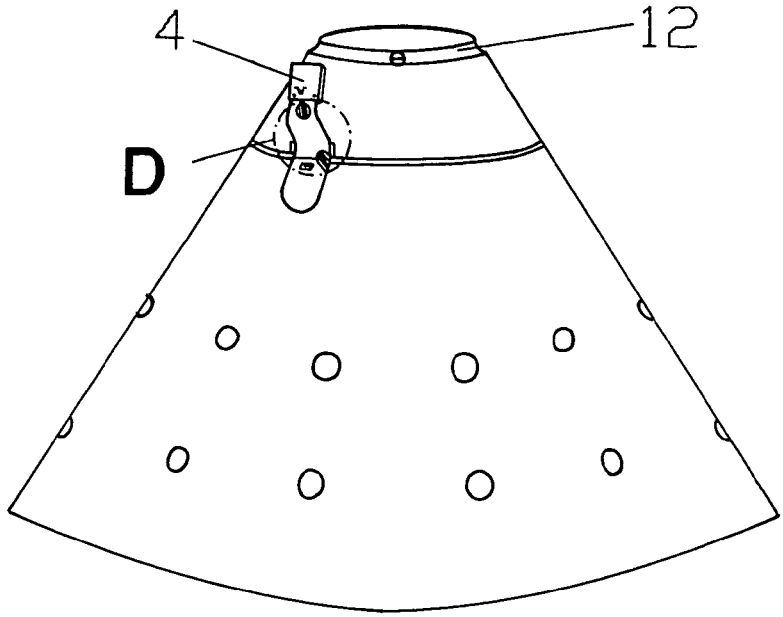
FIG. 8 is a front view of the inner skirt cover of the luminous inner skirt in the present invention.
Figure 9:
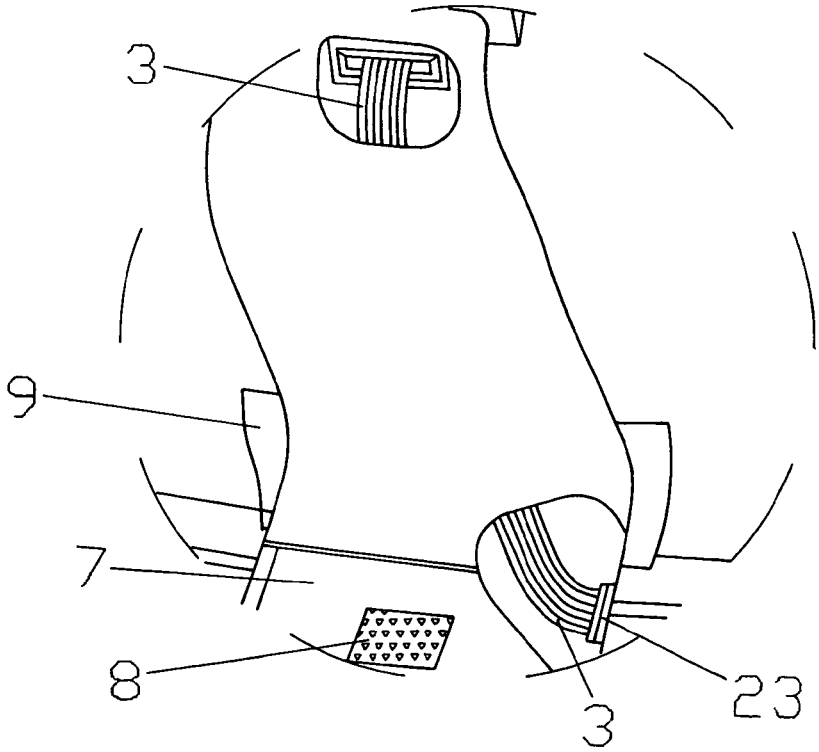
FIG. 9 is a magnified view of the mark D in FIG. 8 in the present invention.

Further, referring to FIGS. 4 and 7, the cell box 4 is installed thereon with a power switch 15 for the convenience of controlling a power source, and the transparent luminous body shade 18 has its inner and outer surface respectively disposed with light-scattering streaks 19 crossing one another for the sake of intensifying lighting. Furthermore, for producing various colors, the luminous bodies 20 are composed of three different-colored LEDs 17, which are connected in parallel and whose luminous colors consist of red, green and blue.

In addition, the cell box 4 is bored with a power plug slot at the front side of the conductive wire opening 22 for facilitating connecting the conducting wires 3 with the cell box 4. The luminous bodies 20, the switch 11 and the power plug 29 are connected by means of the conducting wires, and the power plug 29 is inserted through the pocket hole from the surface of the outer skirt 1 and then connected with the power plug slot of the cell box 4.

While the preferred embodiment of the invention has been described above, it will be recognized and understood that various modifications may be made therein and the appended claims are intended to cover all such modifications that may fall within the spirit and scope of the invention.

I claim:

1. A luminous skirt comprising:

an outer skirt cover made of transparent material;

an inner skirt cover positioned under said outer skirt cover and composed of an inner skirt, an outer skirt, a cell bag, a cell box, a plurality of luminous bodies, a transparent luminous body shade, a switch and conducting wires;

said cell box provided with a convex conductive wire opening, said conductive wire opening having an end formed with a lug cut with an insert slot, said conducting wires guided out through said conductive wire opening, said cell bag composed of an inner bag and an outer bag fitted together, said outer bag of cell bag having an upper edge of an inner layer aligned to a waist portion of said outer skirt and sewed together, said outer bag of cell bag having an upper portion bored with a power line hole passing through both the inner layer of said outer bag and said outer skirt, said inner bag of said cell bag having an end fastened with the insert slot of said cell box;

said inner skirt having its upper edge folded and sewed together to form a waist portion, said switch secured in an interior of said waist portion of said inner skirt, said inner skirt disposed with a luminous area at the lower portion, said waist portion of said inner skirt having an inner layer bored with an upper switch line hole, said luminous area of said inner skirt bored with a lower switch line hole, a cloth tube positioned between said upper and said lower switch line hole and communicating with them;

said outer skirt and said inner skirt overlapped and fitted with each other, said waist portion of said outer skirt sewed together with a portion of said inner skirt near an upper side of said lower switch line hole, said outer skirt and said inner skirt having lower edges aligned to each other and sewed together; and, said luminous bodies positioned in the interior of said luminous body shade, said luminous body shade having a circumferential edge bored with a plurality of thread holes spaced apart, said thread holes sewed with said luminous area between said inner skirt and said outer skirt, said switch having its peripheral edge bored with thread holes spaced apart, said thread holes of said switch sewed with the inner layer of said waist portion of said inner skirt, said conducting wires having upper ends inserted through said power line hole and connected with said cell box, said conducting wires having lower ends orderly inserted through said upper switch line hole and said cloth tube and said lower switch line hole and then connected with said switch and said luminous bodies.

2. The luminous skirt as claimed in claim 1, wherein said conductive wire opening of said cell box has its front end bored with a power plug slot, and said luminous bodies, said switch and a power plug are connected together by means of said conducting wires, said power plug inserted through a pocket hole from surface of said outer skirt and then connected with said power plug slot.

3. The luminous skirt as claimed in claim 1, wherein said cell box is installed thereon with a power switch.

4. The luminous skirt as claimed in claim 1, wherein said transparent luminous body shade has its inner and outer surface respectively provided with a plurality of light-scattering streaks crossing one another.

5. The luminous skirt as claimed in claim 1, wherein said luminous bodies consist of three LED connected in parallel.

6. The luminous skirt as claimed in claim 1, wherein the luminous colors of said three LED respectively are red, green and blue.

* * * * *